US005089930A

United States Patent [19]

Chass

[11] Patent Number: 5,089,930

[45] Date of Patent: Feb. 18, 1992

[54] TEMPERATURE COMPENSATED LINEAR VARIABLE TRANSFORMER

[75] Inventor: Jacob Chass, Forest Hills, N.Y.

[73] Assignee: Pickering Controls, Inc., Plainview, N.Y.

[21] Appl. No.: 684,600

[22] Filed: Apr. 12, 1991

[51] Int. Cl.[5] ..... H01F 15/16

[52] U.S. Cl. ..... 361/140; 336/73; 336/87; 336/136; 336/179

[58] Field of Search ..... 335/256, 266; 361/140; 336/179, 73, 87, 136, 83

[56] References Cited

U.S. PATENT DOCUMENTS 2,494,579 1/1950 Pimlott et al. ..... 336/136

3,183,126 5/1965 Curtis et al. ..... 336/179

*Primary Examiner*—Thomas J. Kozma

*Attorney, Agent, or Firm*—Kane, Dalsimer, Sullivan, Kurucz, Levy, Eisele and Richard

[57] ABSTRACT

A differential transformer is provided comprising an elongated bobbin having primary and secondary coils wound about separated sections. A ferromagnetic armature is movably disposed within a core of the bobbin for movement between the separated sections. A tube of electrically conducting material surrounds the bobbin core. The tube is formed of a material whose resistance varies with temperature in the same manner as the primary coil.

8 Claims, 1 Drawing Sheet

TEMPERATURE COMPENSATED LINEAR VARIABLE TRANSFORMER

BACKGROUND OF THE INVENTION

The present invention relates to differential transformers and in particular to a linear variable differential transformer whose output is not influenced by temperature variation.

Differential transformers of the type composed of a bobbin of nonmagnetic, nonconductive material, and having primary and secondary coils wound thereon with a displaceable magnetic armature core, the position of which determines the number of secondary coils magnetically coupled with the primary coil are well known. Such devices are disclosed, for example, in U.S. Pat. No. 3,376,533 and are widely used to measure linear displacement.

In low frequency applications a high proportion of the impedance of the transformer comprises the resistance of the coils. The resistance is temperature sensitive and therefore the output of the transformer will be affected by ambient temperature. As noted, the effect is more prominent as the frequency of the exciting voltage decreases. This may create a problem in many applications especially where a small displacement of the armature is sought to be detected and the operating voltage is low frequency (i.e., 400 Hz or less).

SUMMARY OF THE INVENTION

In view of the above, it is the principal object of the present invention to provide a linear variable differential transformer whose output is compensated for temperature variations.

A further object is to provide such a device which may be compactly packaged and which may be used with a variety of winding configurations.

The above and other beneficial objects and advantages are attained in accordance with the present invention by providing a differential transformer comprising an elongated bobbin about separated sections of which the primary and secondary coils are wound. A ferromagnetic armature is movably disposed within the core of the bobbin for movement between the separated sections. To provide the desired temperature compensation a tube of electrically conducting material surrounds the bobbin core. The tube is formed of a material whose resistance varies with temperature in the same manner as the primary coil.

DETAILED DESCRIPTION OF THE PREFERRED EMBODIMENT

Figure 1:
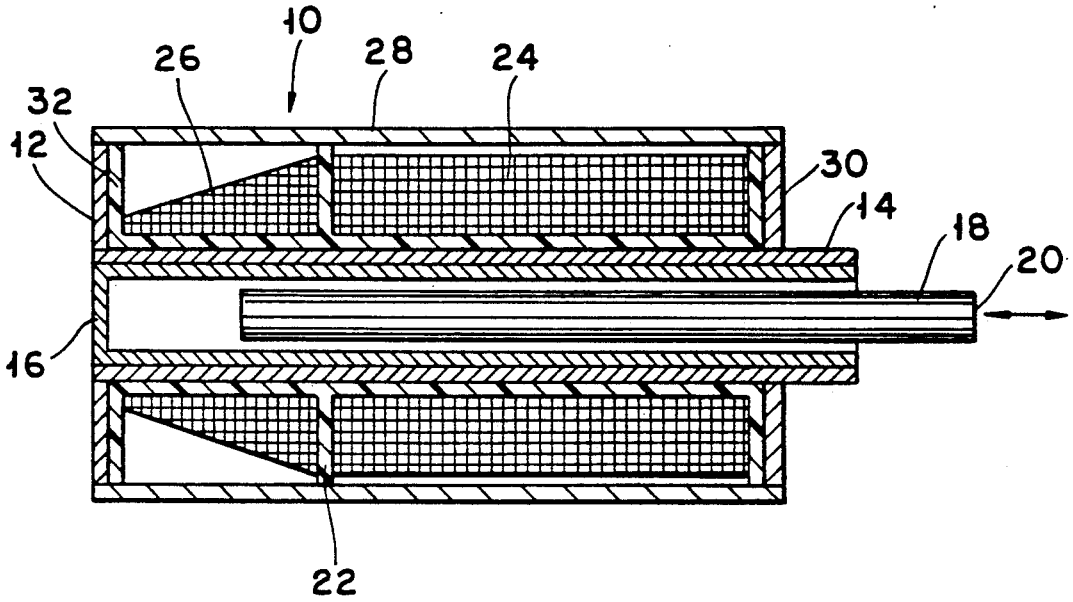
FIG. 1 is a side elevational sectional view of a differential transformer in accordance with the present invention.

Reference is now made to the drawings and to FIG. 1 in particular wherein a differential transformer in accordance with the present invention is depicted. The transformer 10 comprises a bobbin 12 formed of a suitable nonmagnetic, nonconducting material such as a plastic. The bobbin 12 has a hollow center core which extends its entire length. A copper tube 14 is fitted into the core and a stainless steel tube 16 is fitted within and closely adjacent to the copper tube. While separate tubes are shown, the copper outer tube 14 may be plated onto the exterior of the stainless steel tube 16. A ferromagnetic armature 18 is slidably fitted into the stainless steel tube 16 from an open end of the tube. The opposite end of the tube 16 is closed.

Figure 3:
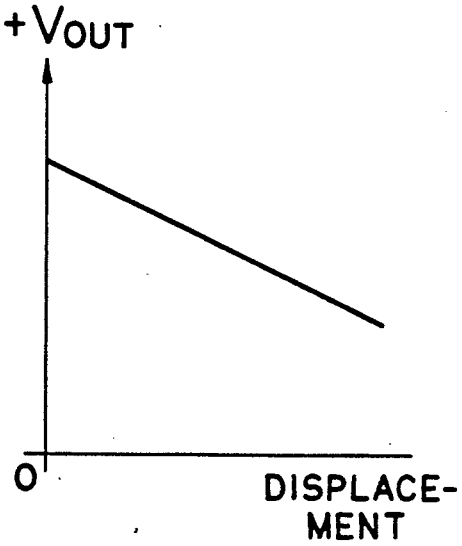
FIG. 3 is a curve depicting the output of the transformer as a function of the armature displacement.

The bobbin 12 is provided with at least one flange 22 which separates the bobbin into two sections. A primary coil 24 is wound about a first bobbin section and a secondary coil 26 is wound about a second section of the bobbin. It is important to note that the core of the bobbin extends through both sections. It should be apparent that the degree of magnetic coupling between the primary coil and the secondary coil is a direct function of the penetration of the armature past the flange 22. In order to have the output linear over a defined operating range, the secondary coil may be provided with a non-uniform profile winding as shown. This will result in a linear output as shown in FIG. 3 for a limited displacement of the armature (i.e., on the order of ¼ inch in an overall bobbin length of 1¼ inches).

The transformer is packaged in a shell 28 of a ferromagnetic material and closed by end plates 30 and 32 also formed of ferromagnetic material. In this connection, the closed end of the stainless steel tube along with the end of the copper tube and end plate 32 serve to seal the end of the transformer.

Figure 2:
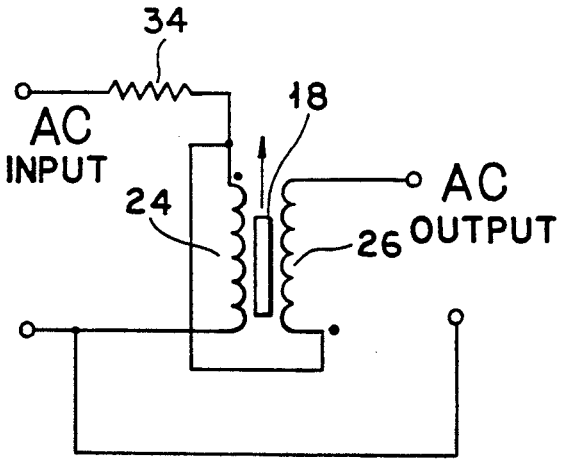
FIG. 2 is a simplified schematic of the primary and secondary circuits of the transformer of FIG. 1.

The copper tubing 14 serves to set up eddy currents, the magnitude of which will vary with temperature with the primary circuit and hence will cancel out the effect of temperature on the output of the transformer (whose primary coil is also formed of copper). As shown in FIG. 2 a resistor 34 is connected in series with a juncture of the input coil 24 and output coil 28. The resistor 34 may be packaged within shell 28 and serves to make the transformer differential by bucking the input. The resistor is formed of a material whose resistance varies with temperature in the same manner as the primary circuit so that the overall effect of a temperature change on the transformer output is negligible.

It should be realized that the modifications may be made to the disclosed embodiment without departing from the scope of the present invention. Thus, the bobbin may be divided into three or more sections by providing an appropriate number of flanges and the primary and/or secondary coils may be divided into component parts connected in series aiding or series bucking relationship to obtain a desired output configuration.

Having thus described the invention, what is claimed is:

1. A transformer comprising:

an elongated bobbin of a non-magnetic, nonconducting material, said bobbin having a hollow center core and at least one flange separating said bobbin into first and second longitudinal sections;

a primary coil of electrically conducting wire disposed about said first section;

a secondary coil of electrically conducting wire disposed about said second section;

an armature of ferromagnetic material movably disposed within said core and extending at least partially into said first and second sections; and, a first tube within said core disposed about said armature, said first tube being formed of an electrically conducting material having resistance characteristics which vary with temperature in the same fashion as said primary coil.

2. The invention in accordance with claim 1 further comprising a second tube of a non-magnetic material disposed within said first tube and about said armature, said second tube being formed of a non-magnetic material.

3. The invention in accordance with claim 2 wherein one end of said second tube is closed.

4. The invention in accordance with claim 2 wherein said first tube is plated over said second tube.

5. The invention in accordance with claim 1 wherein at least one of said coils is wound in a non-uniform profile.

6. The invention in accordance with claim 2 further comprising a ferromagnetic shell disposed about said bobbin.

7. The invention in accordance with claim 1 further comprising a resistor in series with a juncture of said primary and secondary windings.

8. The invention in accordance with claim 7 wherein said resistor is formed of a material having resistance characteristics which vary with temperature in the same fashion as said primary coil.

* * * * *